US008500468B2

(12) United States Patent
Gravolin et al.

(10) Patent No.: US 8,500,468 B2
(45) Date of Patent: Aug. 6, 2013

(54) PROTECTIVE HOUSING ASSEMBLY AND CONNECTOR

(76) Inventors: Sandra Lorraine Gravolin, Maclean (AU); Dennis Ronald Gravolin, Maclean (AU)

( * ) Notice: Subject to any disclaimer, the term of this patent is extended or adjusted under 35 U.S.C. 154(b) by 0 days.

(21) Appl. No.: 13/278,911

(22) Filed: Oct. 21, 2011

(65) Prior Publication Data

US 2012/0108089 A1 May 3, 2012

(51) Int. Cl.
*H01R 13/44* (2006.01)

(52) U.S. Cl.
USPC ..... 439/144; 439/136; 439/147

(58) Field of Classification Search
USPC ..... 439/135, 136, 142, 144, 147
See application file for complete search history.

(56) References Cited

U.S. PATENT DOCUMENTS 1,630,401 A * 5/1927 Meyer ..... 439/144
1,872,367 A * 8/1932 Van Emden ..... 439/144
2,158,385 A * 5/1939 Schwien ..... 439/35
2,496,208 A * 1/1950 Hasselbaum ..... 439/144
2,593,182 A * 4/1952 Quackenbush ..... 439/589
2,932,811 A * 4/1960 Abraham ..... 439/148
3,239,791 A * 3/1966 Fyrk ..... 439/144
3,284,753 A * 11/1966 Goldbaum ..... 439/142
3,659,248 A * 4/1972 Mann et al. ..... 439/144
3,887,256 A * 6/1975 Klimek et al. ..... 439/142
3,915,476 A * 10/1975 Burkle ..... 280/422
4,017,136 A * 4/1977 Sasgen ..... 439/503
4,037,907 A * 7/1977 Klimek et al. ..... 439/142
4,059,322 A 11/1977 Fellner
4,061,407 A * 12/1977 Snow ..... 439/35
4,072,381 A * 2/1978 Burkhart et al. ..... 439/144
4,106,834 A * 8/1978 Horowitz ..... 439/142
4,113,333 A * 9/1978 Horowitz ..... 439/97
4,154,495 A * 5/1979 Crewse ..... 439/35
4,245,875 A * 1/1981 Shaffer et al. ..... 439/144
4,312,553 A * 1/1982 Lyckesjo ..... 439/281
4,770,644 A * 9/1988 Feder ..... 439/166
4,784,610 A * 11/1988 Stuart ..... 439/144
4,793,819 A * 12/1988 Berg ..... 439/142
4,842,532 A * 6/1989 Krause ..... 439/174
5,030,120 A * 7/1991 Hartley ..... 439/144
5,302,141 A * 4/1994 O'Reilly et al. ..... 439/680
5,385,476 A * 1/1995 Jasper ..... 439/38
5,571,023 A 11/1996 Anthony
5,747,739 A * 5/1998 Moeller ..... 174/67
5,800,188 A * 9/1998 Barber et al. ..... 439/142
5,873,744 A * 2/1999 Ramos, Jr. ..... 439/144
6,041,155 A * 3/2000 Anderson et al. ..... 385/139

(Continued)

FOREIGN PATENT DOCUMENTS

AU 325381 S 3/2009

*Primary Examiner* — Ross Gushi
(74) *Attorney, Agent, or Firm* — Shlesinger, Arkwright & Garvey, LLP

(57) ABSTRACT

A connector, comprises a connector assembly; a main housing having an internal chamber for receiving therein the connector assembly; and a housing cover which mates with the main housing to cover the internal chamber. The main housing includes an opening at one end of the main housing with a removable and retractable cover permitting access to the internal chamber. A mating connector is connected to the connector assembly, the mating connector including a fastening tab; and the fastening tab including a main tab that is interlocked with the removable cover to prevent the mating connector from unintentionally disconnecting from the connector assembly. A protective housing assembly is also disclosed.

21 Claims, 22 Drawing Sheets

U.S. PATENT DOCUMENTS

| | | | | |
|---|---|---|---|---|
| 6,054,779 | A * | 4/2000 | Zubko | 307/10.8 |
| 6,171,118 | B1 * | 1/2001 | Witkowski et al. | 439/142 |
| 6,273,756 | B1 * | 8/2001 | Ward et al. | 439/607.41 |
| 6,287,136 | B1 | 9/2001 | Deutsch | |
| 6,450,833 | B1 * | 9/2002 | Brown et al. | 439/518 |
| 6,520,782 | B2 * | 2/2003 | Mori | 439/138 |
| 6,554,626 | B2 * | 4/2003 | Ramos, Jr. | 439/144 |
| 6,705,880 | B2 * | 3/2004 | Rhude | 439/144 |
| 6,802,725 | B2 * | 10/2004 | Rowland et al. | 439/144 |
| 6,851,958 | B1 * | 2/2005 | Rowland et al. | 439/142 |
| 7,189,085 | B1 * | 3/2007 | Yang | 439/144 |
| 7,238,056 | B2 * | 7/2007 | McCoy | 439/660 |
| 7,258,556 | B1 * | 8/2007 | Boutros et al. | 439/142 |
| 7,575,450 | B2 * | 8/2009 | Williams et al. | 439/144 |
| 7,758,360 | B2 * | 7/2010 | Lesage et al. | 439/147 |
| D640,639 | S * | 6/2011 | Gravolin et al. | D13/156 |
| 8,288,651 | B2 * | 10/2012 | Smith | 174/53 |
| 2002/0142637 | A1 * | 10/2002 | Rhude | 439/142 |
| 2004/0161957 | A1 * | 8/2004 | Rowland et al. | 439/142 |
| 2006/0211284 | A1 * | 9/2006 | Ostmoe et al. | 439/135 |
| 2012/0015535 | A1 * | 1/2012 | Lin et al. | 439/136 |
| 2012/0108089 | A1 * | 5/2012 | Gravolin et al. | 439/136 |

* cited by examiner

PROTECTIVE HOUSING ASSEMBLY AND CONNECTOR

RELATED APPLICATIONS

The present application is related to applicant's Australian patent application No. AU2009201426 published on Oct. 28, 2010 and applicant's U.S. Design Pat. No. D640,639, issued on Jun. 28, 2011, the disclosures of which are hereby incorporated by reference.

FIELD OF THE INVENTION

The present invention relates to a protective housing assembly for electrical connectors and in particular a protective housing assembly which encases an electrical connector for physical protection and secures a connected mating connector from inadvertent disconnection.

The invention has been developed primarily as a protective housing assembly for electrical connectors and will be described hereinafter with reference to this application. However, it will be appreciated that the invention is not limited to this particular field of use.

BACKGROUND OF THE INVENTION

Any discussion of the prior art throughout the specification should in no way be considered as an admission that such prior art is widely known or forms part of the common general knowledge in the field.

There are many types of electrical connector's available with the main purpose to connect and supply electrical current to a mating connector. There are many electrical connectors that are used in applications which they were physically not designed for or certain connectors may be designed for the application however lack essential physical protective features to operate correctly and prolong their operational life. An example of this is using a heavy duty connector assembly made for fixed interior use in or on the exterior of a motor vehicle. In such circumstances the connector is vulnerable to the intake of dust and moisture as well as exposed to extreme vibration. Furthermore the mounting of the connector may not be sufficient to make it securely attached to the vehicle. Any mating connector would suffer the same problems. The mating connection between the two connectors could also prove to make a poor electrical connection and possibly even be disconnected due to vibration because of incorrect mounting and mating retaining setups.

Attempts have been made to protect electrical connectors in the form of molded housings. Conventional housings of this nature include those found in WO/2005/069444 and WO/2009/043862.

WO/2005/069444 discloses a housing for a connector module in which the housing has a frame for which the connector module can be inserted to. A stirrup device which is movable about the housing serves the purpose of aiding the coupling of an additional connector as well as providing a locking means for the initial connector module in the frame.

This device while providing a housing has a main objective of locking the connector module to the housing by way of stirrup device. The connector module is not fixable to the main housing with out the stirrup device engaged. Furthermore the device does not include a complete barrier to protect the connector module from environmental conditions.

WO/2009/043862 discloses connector cover with first and second connecting members which are able to be connected together to cover a connector. At least one of the parts has a protruding locking pin to engage and lock the connector cover to a separate housing.

The connector cover does not have a fixing means to the actual connector itself however; instead the assembly relies on the connecting of the first and second connecting members together to hold the housing, total stability is only achieved when the connector cover is engaged into the separate housing. This device also lacks a complete barrier to protect the housed connector inside the cover assembly.

It has now been found by the present inventors that a connector cover assembly can be economically constructed to form a complete barrier to physically protect an electrical connector without affecting its operation or versatility. It has also been found by the present inventors that such an assembly can be used with different connector types.

OBJECTS OF THE INVENTION

It is an object of the present invention to overcome or ameliorate at least one of the disadvantages of the prior art, or to provide a useful alternative.

It is yet another object of the present invention to provide a connector housing assembly which provides a securing means for fastening a connector into a main housing of the connector cover assembly to ensure stability.

A further object of the invention provides a sealed physical protective barrier for a connector seated into the connector cover assembly, in which the barrier also allows access when a mating connector is needed to make a connection to the connector.

Another object of the invention is to provide solid points for mounting the connector housing assembly to a surface.

It is yet a further object of the invention to provide a connector housing assembly which has means to secure the physical connection of a mating connector to the connector housed within the connector housing assembly.

SUMMARY OF THE INVENTION

The present invention provides a protective housing assembly for a connector, comprising a main housing having an internal chamber for receiving therein a connector assembly, the internal chamber having a first dowel for insertion into an aperture in the connector assembly, thereby to position the connector assembly within the chamber; a housing cover including a second dowel for insertion into the aperture of the connector assembly, thereby to interlock the housing cover with the connector assembly and the main housing, the housing cover being attached to the main housing to cover the internal chamber; an opening at one end of the main housing with a removable and retractable cover to permit access to the internal chamber; another opening at another end of the main housing to permit access to the internal chamber; and the main housing and the housing cover including flanges for attachment to a surface.

The present invention also provides a connector comprising a connector assembly; a main housing having an internal chamber for receiving therein the connector assembly; and a housing cover which mates with the main housing to cover the internal chamber. The main housing includes an opening at one end of the main housing with a removable and retractable cover permitting access to the internal chamber. A mating connector is connected to the connector assembly, the mating connector including a fastening tab; and the fastening tab including a main tab that is interlocked with the removable cover to prevent the mating connector from unintentionally disconnecting from the connector assembly.

BRIEF DESCRIPTION OF THE DRAWINGS

In order that the invention may be better understood and put into practical effect, reference will now be made to the accompanying drawings in which:—

DETAILED DESCRIPTION OF THE INVENTION

Figure 1:
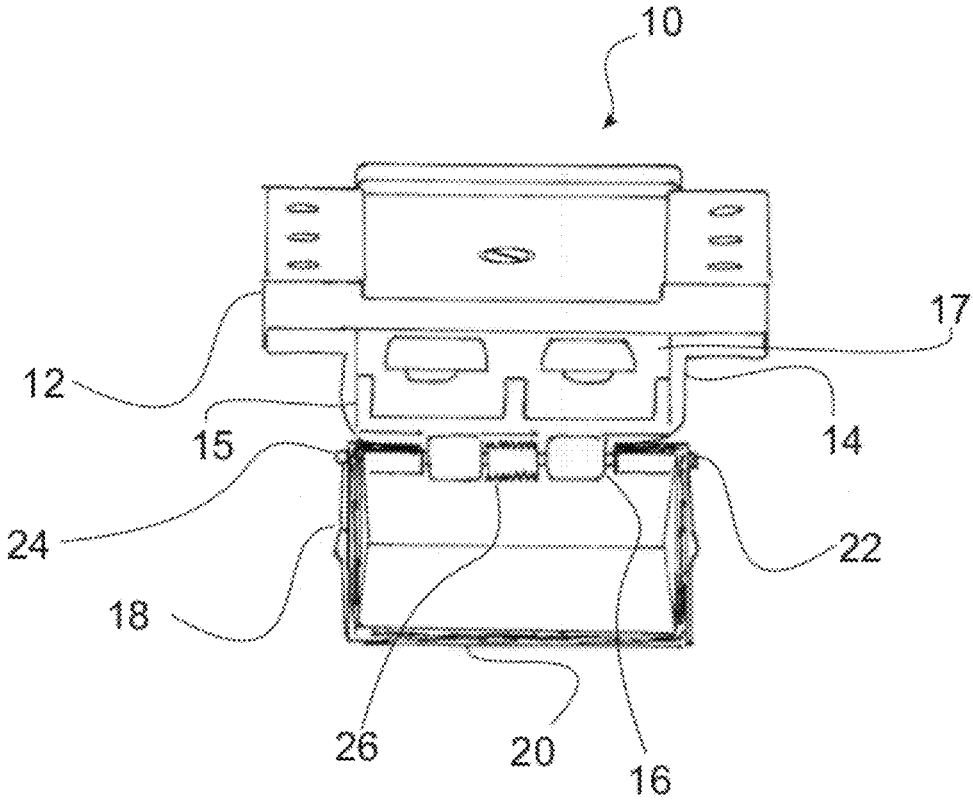
FIG. 1 is a front perspective view of a protective housing assembly in a fully assembled condition with a removable cover in the open position.

Referring to the drawings, the fully assembled protective housing assembly 10 is shown in FIG. 1. A housing cover 12 is attached to and interlocks with a main housing 14. At the front end of the protective housing assembly 10 there is an opening 15 to an internal chamber 17 which is molded into the interior of the main housing 14. The opening 15 is defined by means of a removable cover 18. The cover includes a weather proof seal 20, which when retracted against the main body 14 closes and seals the opening 15. The removable cover 18 is attached to the main body by a pin 22 which is inserted into a hole 24 in the removable cover 18. The pin 22 also is inserted into pin dowels 16 which are attached to the main body 14. This setup attaches the removable cover 18 to the main body. The removable cover 18 is automatically closed by a spring 26 which applies pressure to the removable cover 18 in the closed position, thus requiring a force to open.

Figure 2:
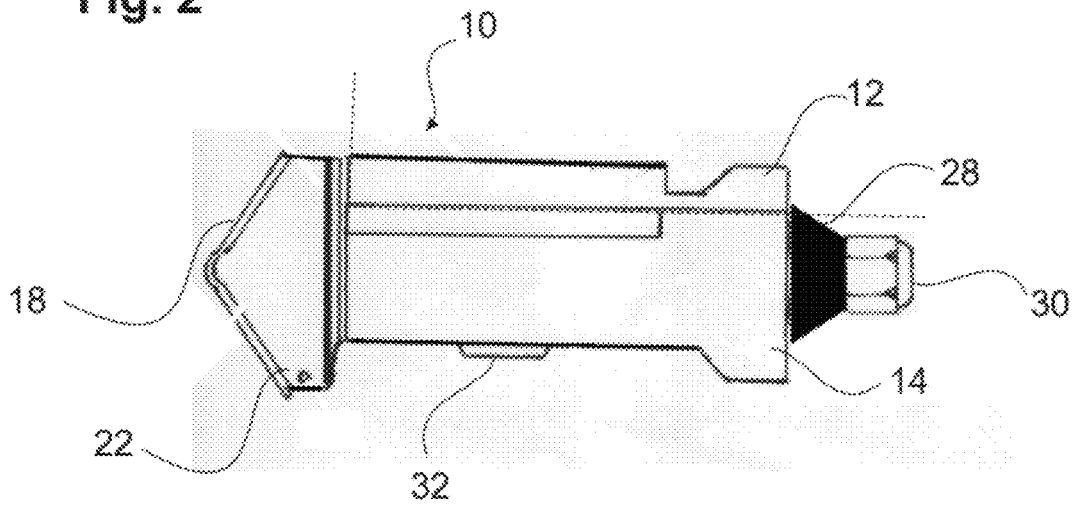
FIG. 2 is a side plan view the protective housing assembly with the removable cover closed.

FIG. 2 shows the removable cover 18 in the closed position, the housing cover 12 and main housing 14 are defined by the lines 3-3. A first form rear sealing device 28 is shown attached to the rear end of the protective housing assembly 10. The first form rear sealing device 28 acts as a cable entry and sealing point into the main housing 14. A gland nut 30 is attached to the rear sealing device 28. An insert 32 is molded into the bottom of the main housing 14. The insert provides means of attaching the housing cover 12 to the main housing 14.

Figure 3:
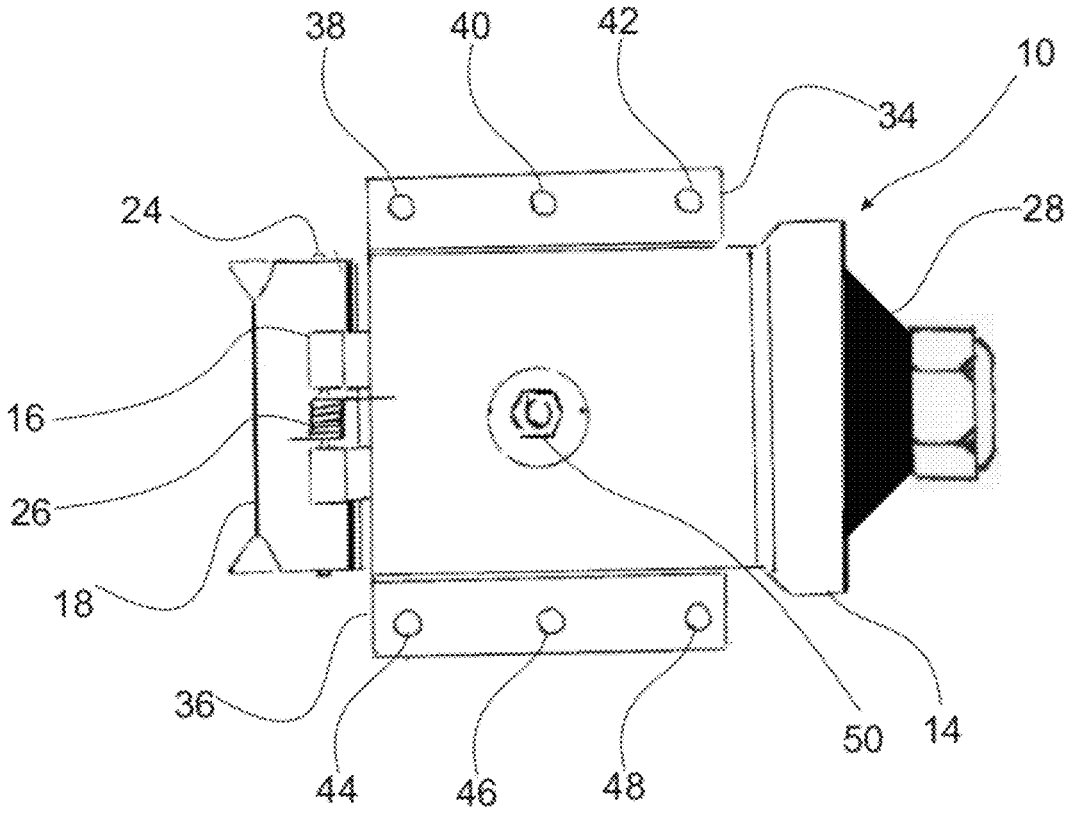
FIG. 3 is a bottom plan view of the protective housing assembly.

As shown in FIG. 3 the main body 14 has bracket flanges 34, 36 attached at each side. Each bracket flange 34, 36 include a plurality of holes 38-48. A main housing aperture 50 is shown placed into the molded insert 32.

Figure 4:
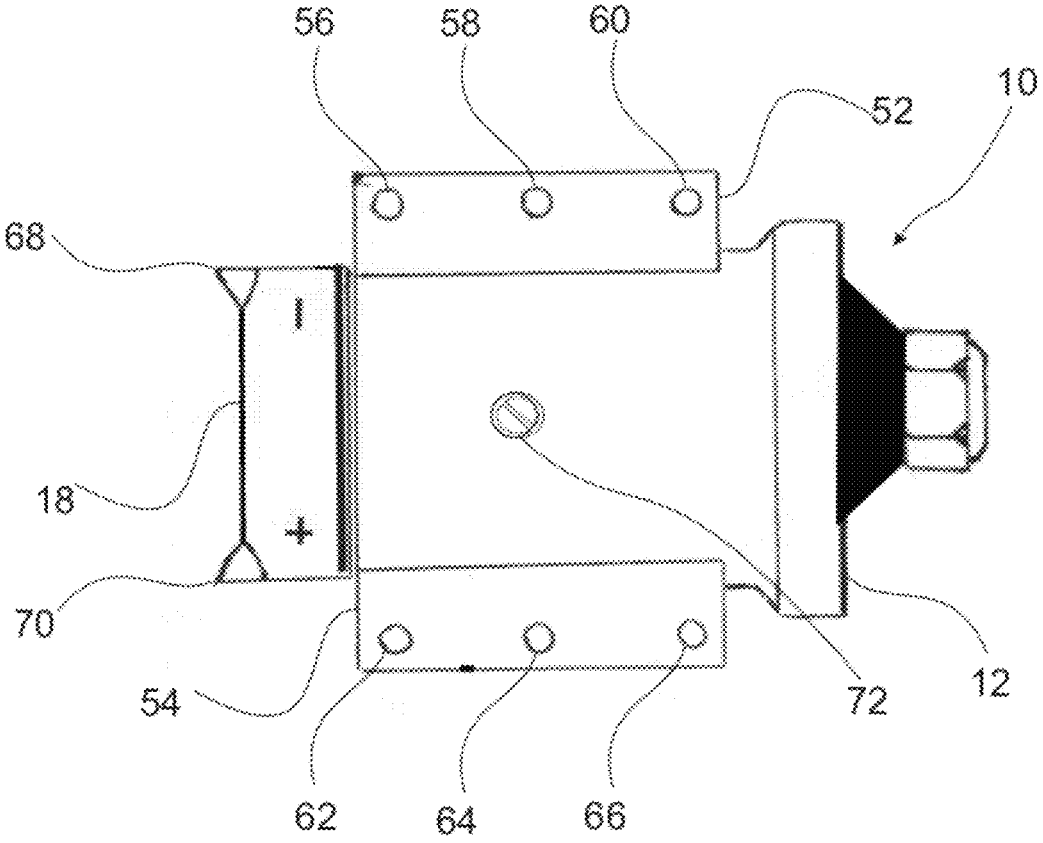
FIG. 4 is a top plan view of the protective housing assembly.
Figure 5:
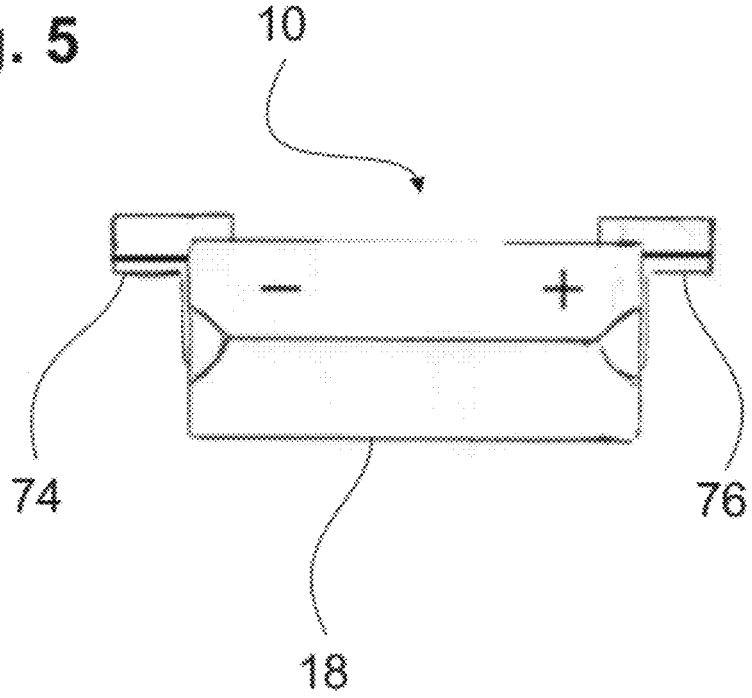
FIG. 5 is a front elevational view of the protective housing assembly with the removable cover closed.

FIG. 4 shows the housing cover 12 which has bracket flanges 52, 54 attached at each side. Each bracket flange 52-54 includes a plurality of holes 56-66. An housing cover aperture 72 is embedded into the housing cover 12 which aligns with the main housing aperture 50 when the housing cover 12 is interlocked with the main body 14. Finger grips 68 and 70 protrude from the retractable cover as shown in FIG. 4. When the housing cover 12 and the main body 14 are interlocked the bracket flanges 34, 36 of the main body 14 align with the bracket flanges 52, 54 of the housing cover 12 to form completed brackets 74, 76 of the protective housing assembly 10.

Figure 6:
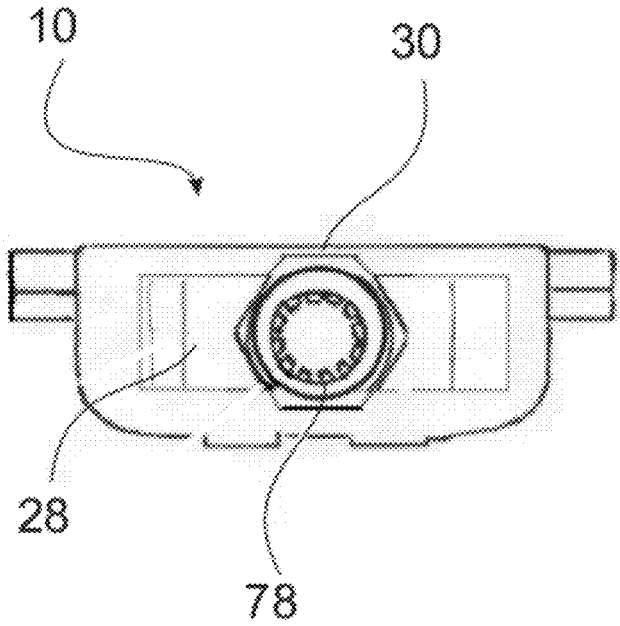
FIG. 6 is an end elevational of the protective housing assembly showing a rear sealing device.

The rear end sealing device 28 is shown in its complete form in FIG. 6. The gland nut 30 compresses a constrictive gland 78 which seals around a cable when tightened.

Figure 7:
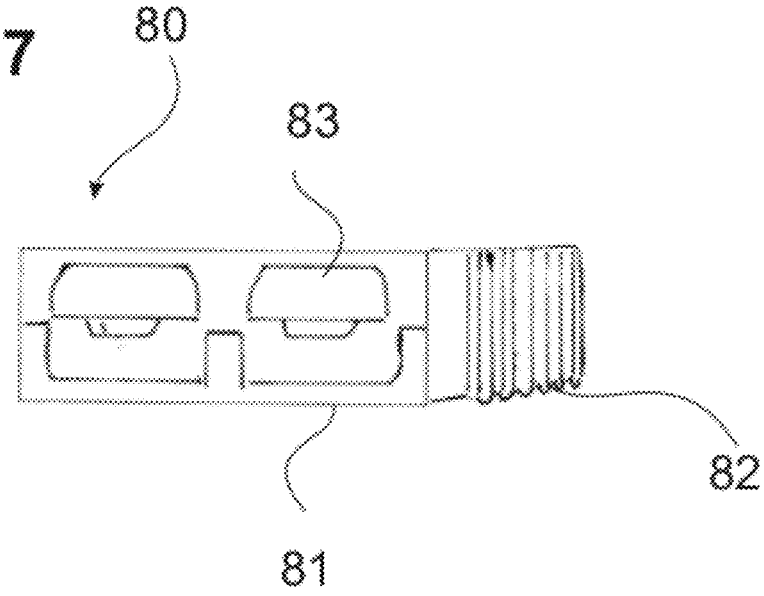
FIG. 7 is a front perspective view of a connector assembly.
Figure 8:
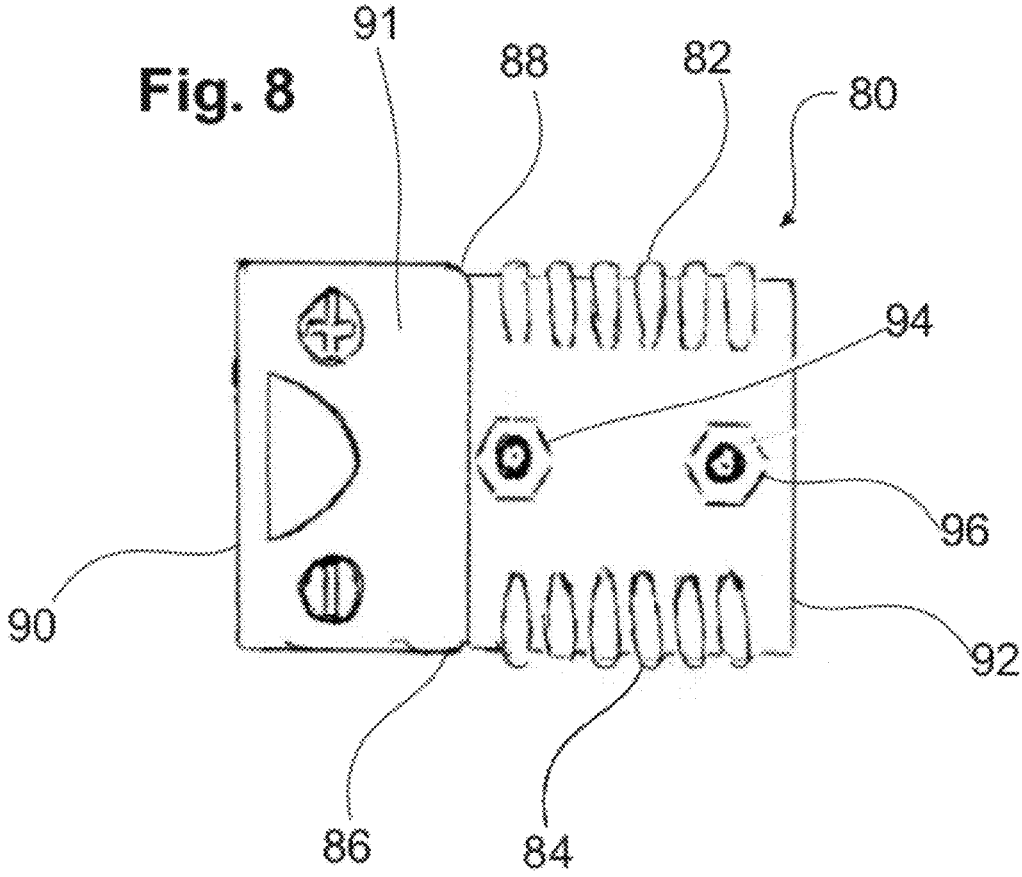
FIG. 8 is a top plan view of the connector assembly.

A connector assembly 80 is illustrated in FIGS. 7 and 8 in its complete form, commonly known to a person skilled in the art as an "Anderson Connector" although many look alike alternatives exist. The connector assembly 80 has a bottom wall 81 and at least one electrical connector 83 housed within it. A plurality of protrusions 82, 84 on each side wall 88, 86 as shown in FIG. 8. The connector assembly 80 also has a front wall 90, a top wall 91, and end wall 92. Two connector assembly apertures 94, 96 extend from the top wall 91 to the bottom wall 81.

Figure 9:
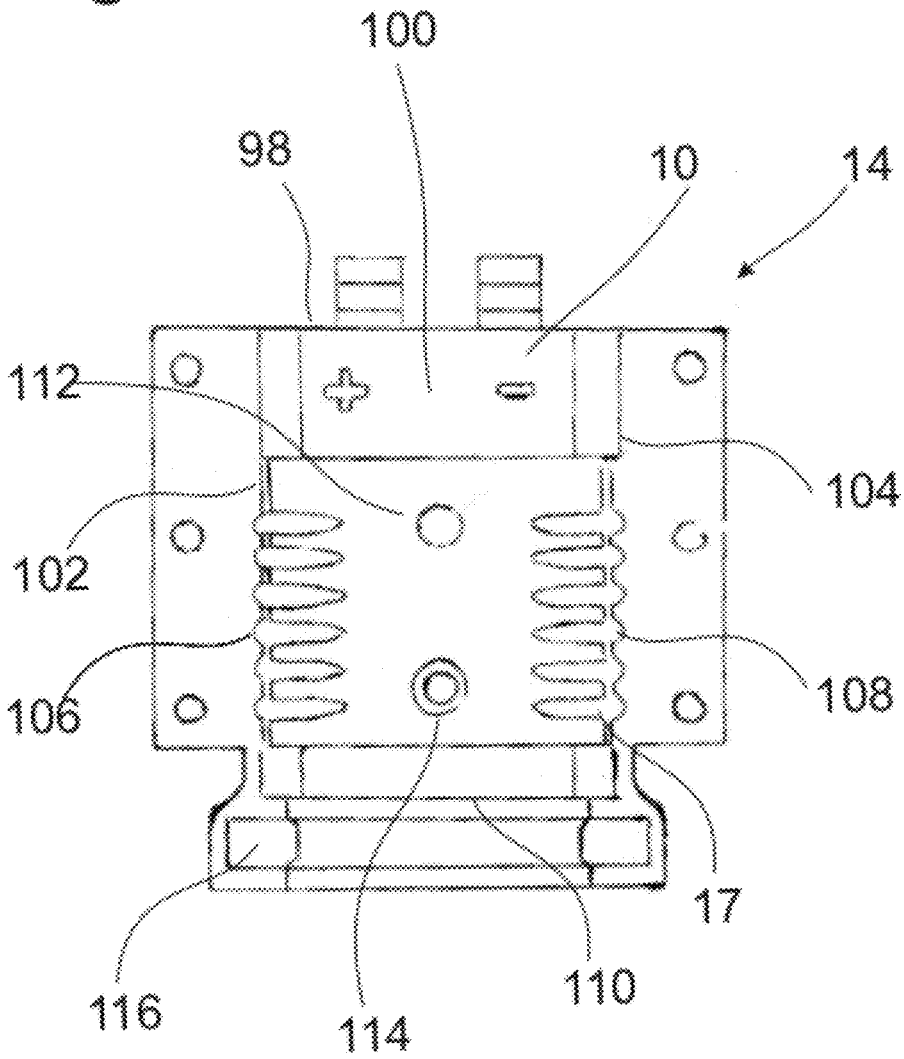
FIG. 9 is a top plan view of the main body showing the elements of the internal section.
Figure 24:
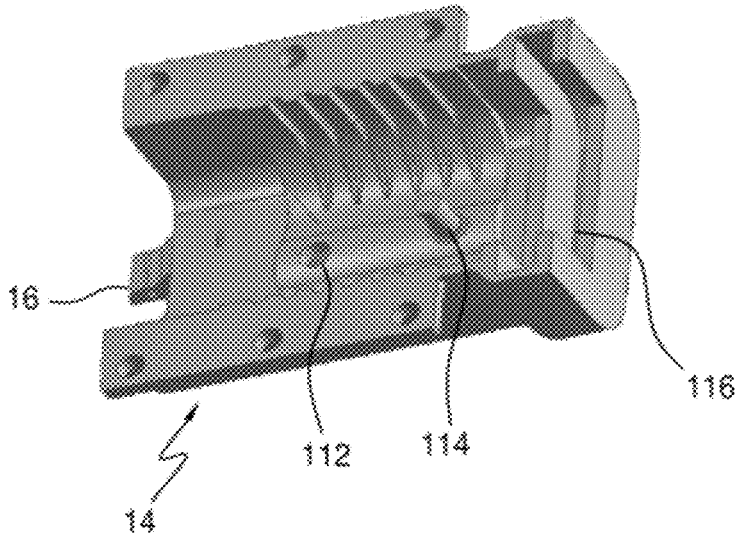
FIG. 24 is a perspective view of the internal structure of the main housing.

FIGS. 9 and 24 show in detail the internal chamber 17 of the main housing 14. The internal chamber is shaped to receive the contours of the connector assembly 80. When the connector assembly 80 is inserted into the internal chamber 17, the internal chamber front wall 98 aligns with the front wall 90 of the connector assembly 80. The internal chamber bottom wall 100 mates with bottom wall 81, internal chamber side walls 102 and 104 also align with side walls 88 and 86 of the connector assembly 80. A plurality of opposing protrusions 108, 106 on each side of the internal chamber 17 are shaped to mate with the protrusions 82, 84 of the connector assembly 80 when inserted into the internal chamber 17. The internal chamber end wall 110 also aligns with the bottom end wall 81. An internal chamber aperture 112 extends to main housing aperture 50 and aligns with connector assembly aperture 94 on the connector assembly 80. An internal chamber locating dowel 114 is also situated on the internal chamber bottom wall 100 and aligns and interlocks with connector assembly aperture 96 on the connector assembly 80. An internal groove 116 is molded into one end of the main body 14 which receives the sealing device 28.

Figure 10:
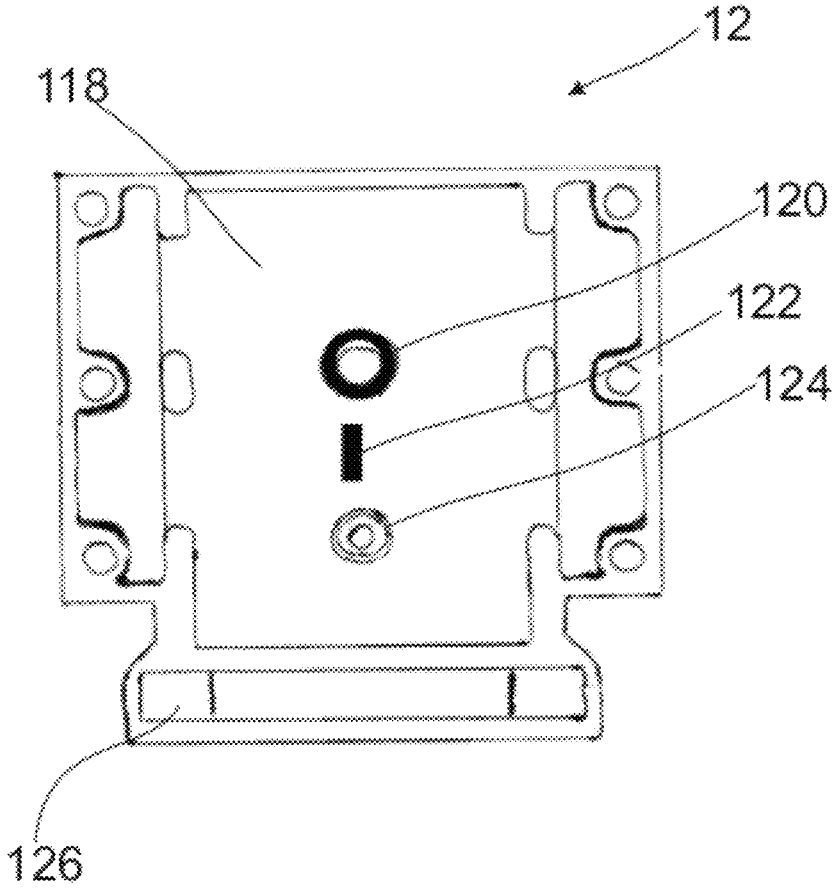
FIG. 10 is a bottom plan view of the top cover showing underside elements.
Figure 23:
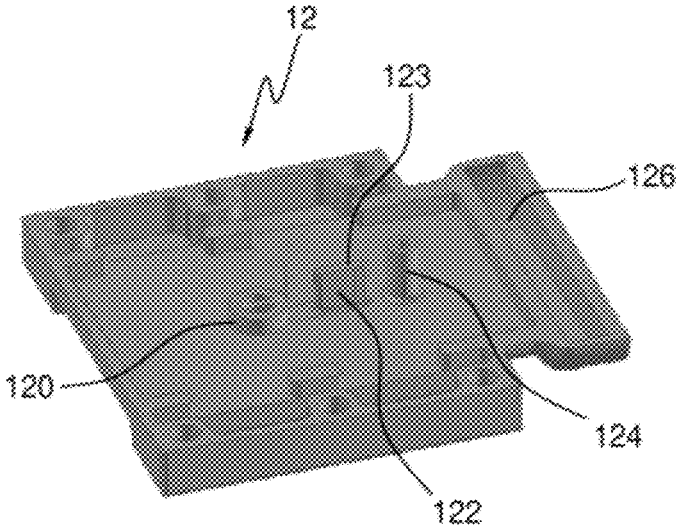
FIG. 23 is a perspective view of the internal structure of housing cover.

The underside of the housing cover 12 is shown in FIGS. 10 and 23. The housing cover internal wall 118 aligns with the top wall 91 of the connector assembly 80. An internal housing cover aperture 120 extend to housing cover aperture 72 and aligns with connector assembly aperture 94 of the connector assembly 80. A rectangular housing cover locating dowel 122 has an outer end 123 that engages against the top wall 91 of the connector assembly 80 to keep the connector assembly 80 from moving up and down within the housing assembly. A round housing cover locating dowel 124 aligns and interlocks with aperture 96 of the connector assembly. An internal groove 126 is molded into one end of the housing cover which aligns with the internal groove 116. The setup of the aperture alignment and dowel alignment provide a fastening mechanism for the connector assembly 80 into the protective cover housing 10.

Figure 11:
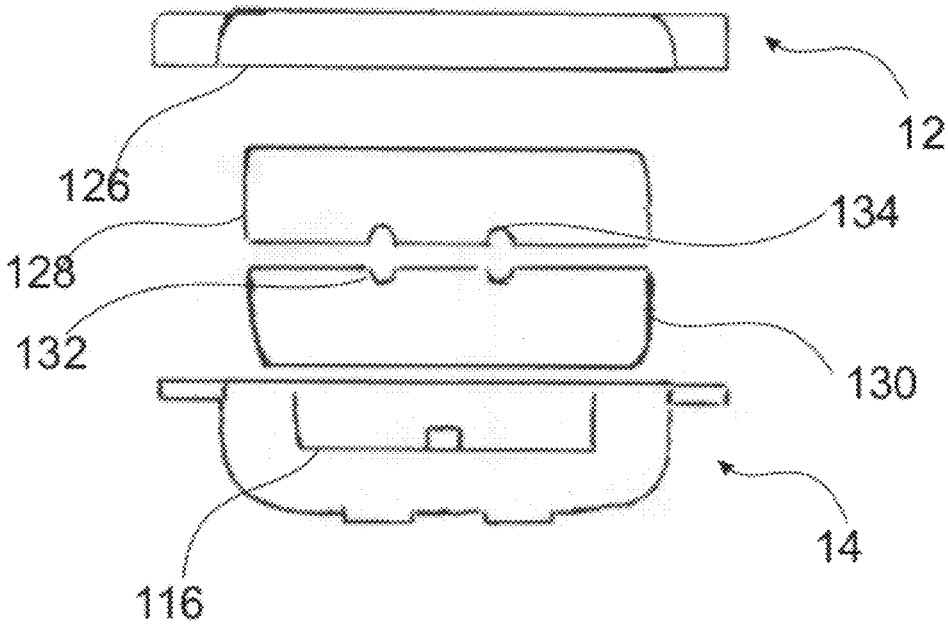
FIG. 11 is an exploded end view of the protective housing assembly showing a second form of sealing means.
Figure 12:
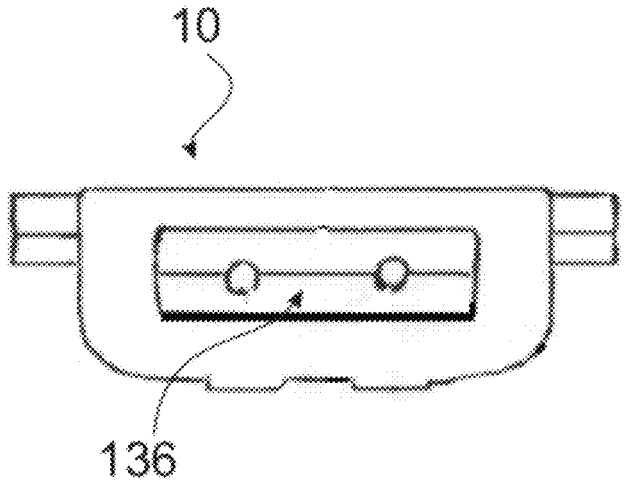
FIG. 12 is a partially assembled end view showing the assembly and second form of sealing means.

As illustrated in FIGS. 11 and 12, top seal 128 and bottom seal 130 are inserted into top groove 126 and bottom groove 116. Each seal being made of a flexible sealing material. Cable cut outs 134 and 132 exist on each top seal 128 and bottom seal 130. FIG. 12 shows how when the protective housing assembly 10 is assembled, top seal 128 and bottom seal 130 align and compress to form a second form sealing device 136 for a cable.

Figure 13:
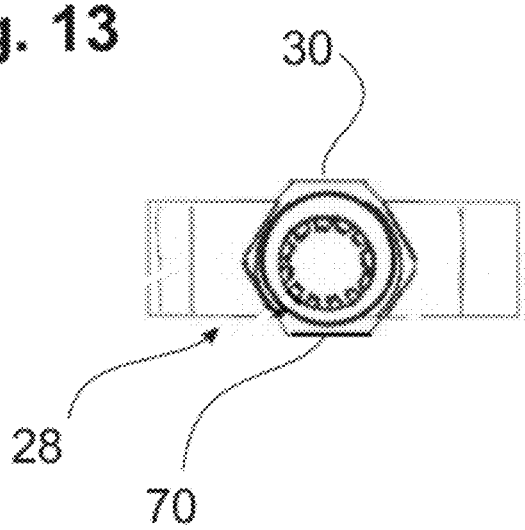
FIG. 13 is an end view of a first form of sealing means.

FIG. 13 shows a first form sealing device 28 with gland nut 30 and constrictive cable gland 70 which seals and grips the cable. The second form sealing device 136 can be used independently of the sealing device 28 and vice versa. Each sealing device 136 and 28 can also be used together within the protective housing assembly 10.

Figure 14:
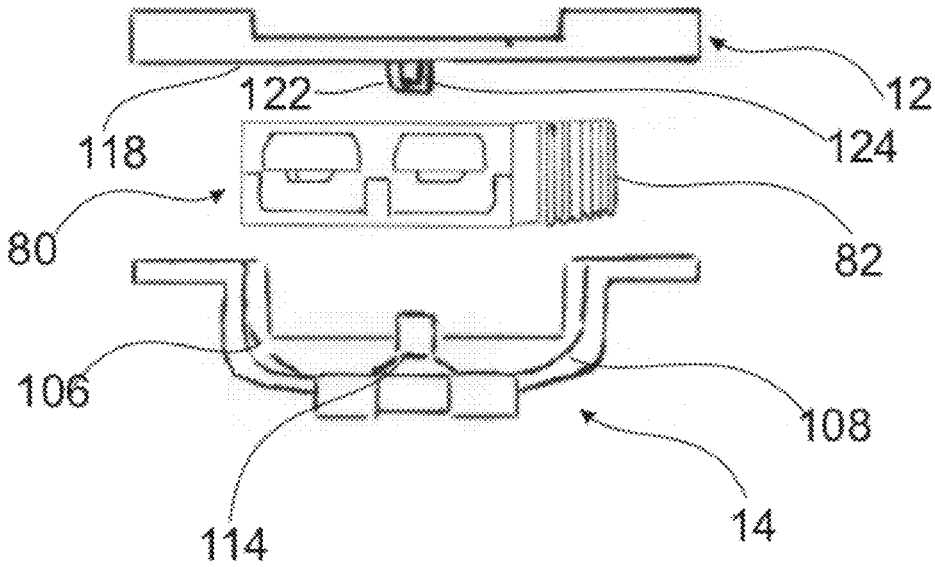
FIG. 14 is an exploded front perspective view of the protective housing assembly showing how the connector assembly is fitted to the protective housing cover.

FIG. 14 Illustrates how the connector assembly 80 is aligned to housing cover 12 and main housing 14 in preparation to assemble the protective housing assembly 10. The connector assembly 80 is inserted into the main housing 14 and aligned with the main housing side walls 106 and 108. The protrusions on the side wall 94 align and mate with protrusions 108 of the internal chamber. Locating dowels 122, 124 and 114 all assist in aligning and securing the connector assembly into the completed protective housing assembly 10.

Figure 15:
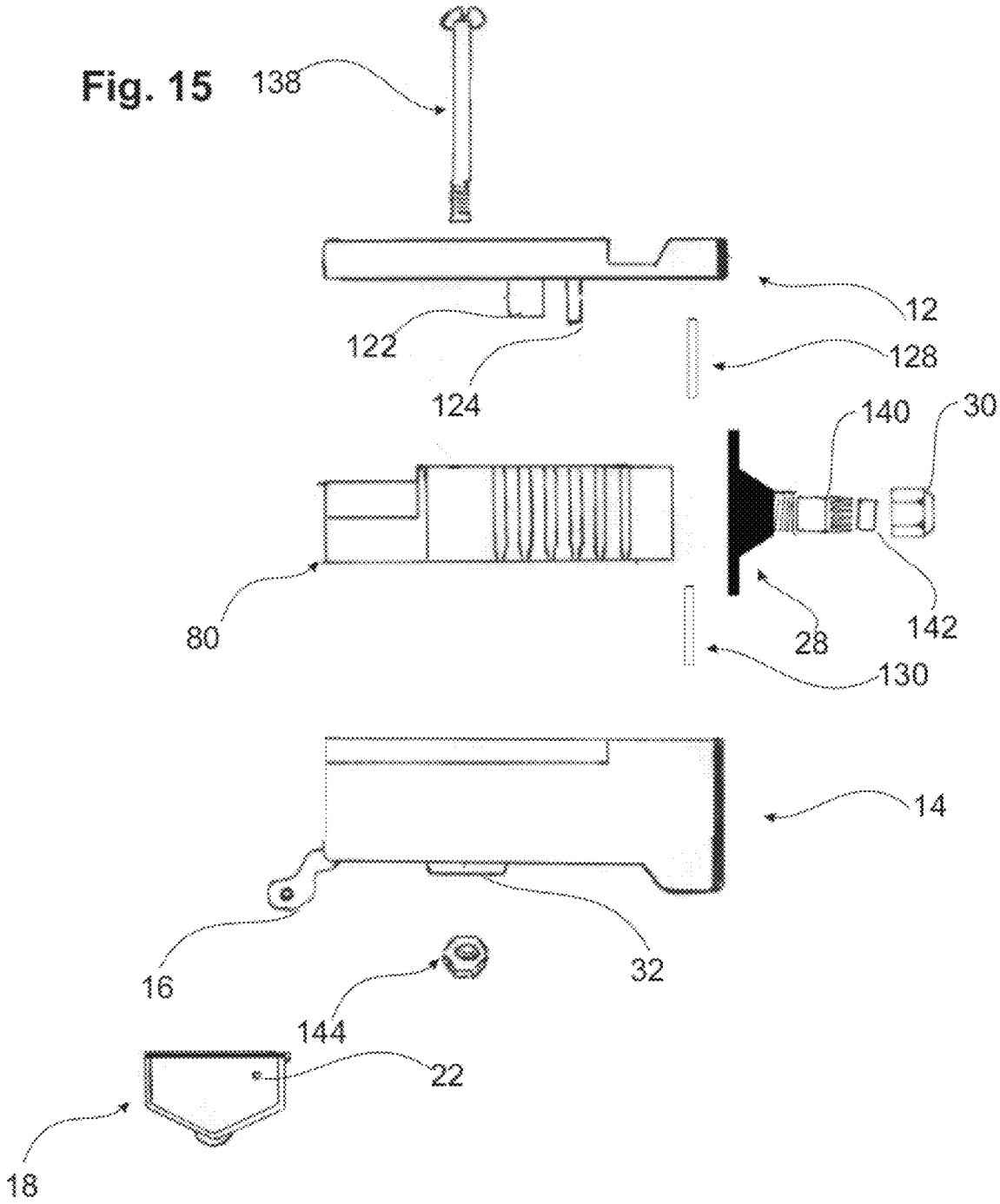
FIG. 15 is an exploded side view of the protective housing assembly in unassembled condition showing exterior components.

FIG. 15 shows an external exploded view of protective housing assembly and in particular a fastener 138 in the form of a bolt is shown which extends through apertures 72, 94 and 50 and can be tightened to an opposing fastener 144 in the form of a nut which is secured into the molded insert 32. The fastener 138 acts as means for attaching and securing the connector assembly 80 to the main housing and also the housing cover 12 to the main housing. A gripping finger gland 140 and constrictive seal form the constrictive gland 72 and are part of the first form sealing device 28.

Figure 16:
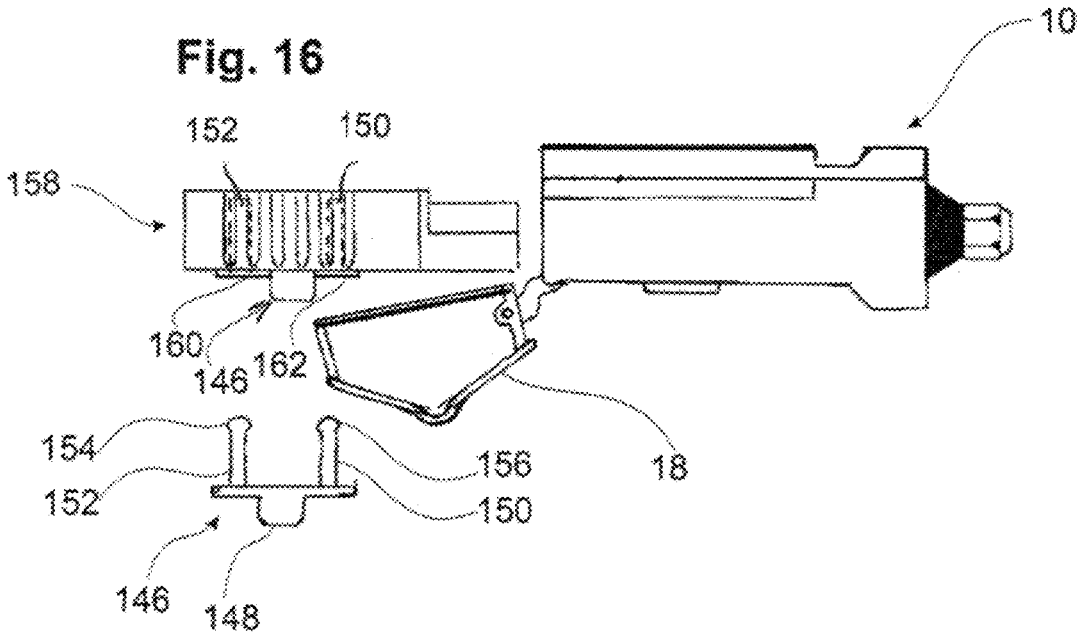
FIG. 16 is a side plan view of the protective housing assembly showing securing means for a mating connector before it is connected to the connector assembly inside the protective housing assembly.
Figure 17:
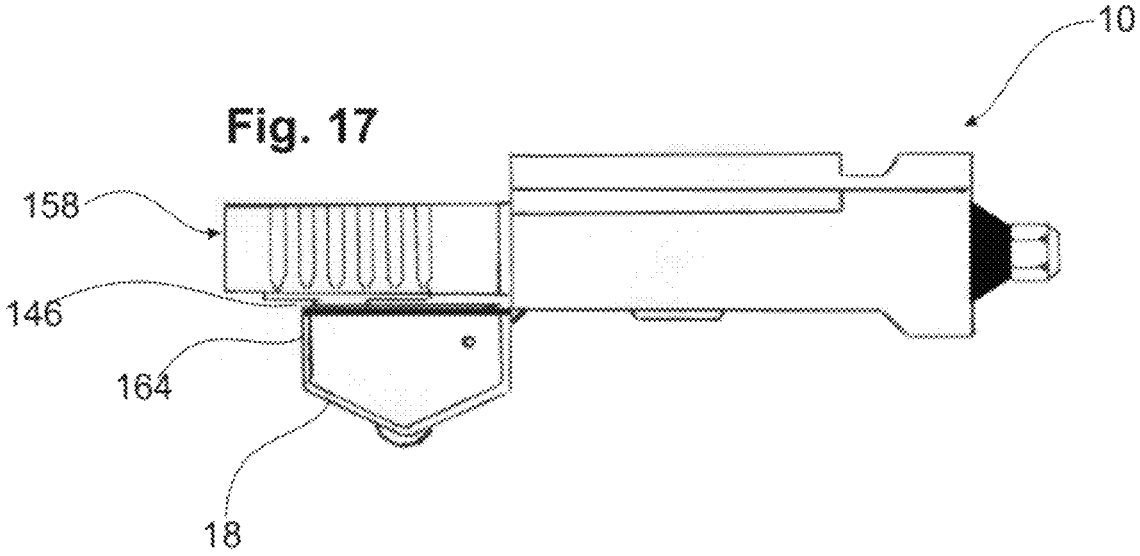
FIG. 17 is a side plan view of the protective housing assembly showing securing means for a mating connector after it is connected to the connector assembly inside the protective housing assembly.

A fastening device 146 is illustrated in FIG. 16 which is inserted into a mating connector 158. The fastening device 146 has a tab 148 extending downwards. Pins 150 and 152 are attached to the fastening device and extend upwards. The pins 150 and 152 have locking heads 154, 156. The fastening tab 146 is inserted into the mating connector 158 by way of pins 150 and 152 being inserted into mating connector apertures 160, 162 respectively. Once fully inserted, locking heads 154 and 156 securely lock the fastening tab 146 to the mating connector 158. Shown in FIG. 17 when the mating connector 158 is inserted into the protective housing assembly, 10 and mated to the connector assembly 80 housed inside, a front wall 164 of the removable cover 18 engages with the main tab 148 of the fastening device, thereby securing the mating connector 158 to the protective housing assembly 10.

Figure 18:
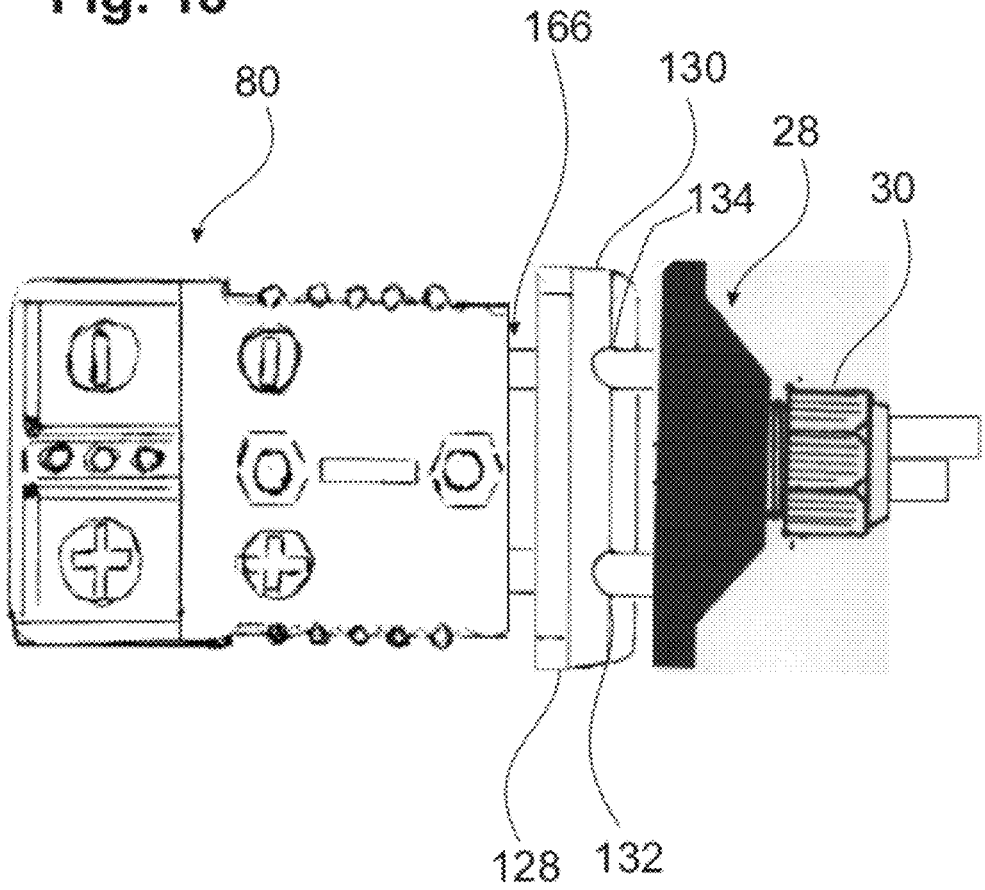
FIG. 18 is a top plan view of the internal section of the main body showing how the first form and second form sealing means can be used together and applied to a cable.

FIG. 18 shows how both first and second form sealing devices 28 and 136 respectively are used together in the protective housing assembly 10. The cable from the connector assembly 80 is first sealed by the top seal haled 128 and bottom seal half which are comprised around cable entry holes 132 and 134 respectively. The cable is then placed through the sealing device 28 for which the gland nut 30 tightens around the constrictive gland 72 forming a secure cable seal.

Figure 19:
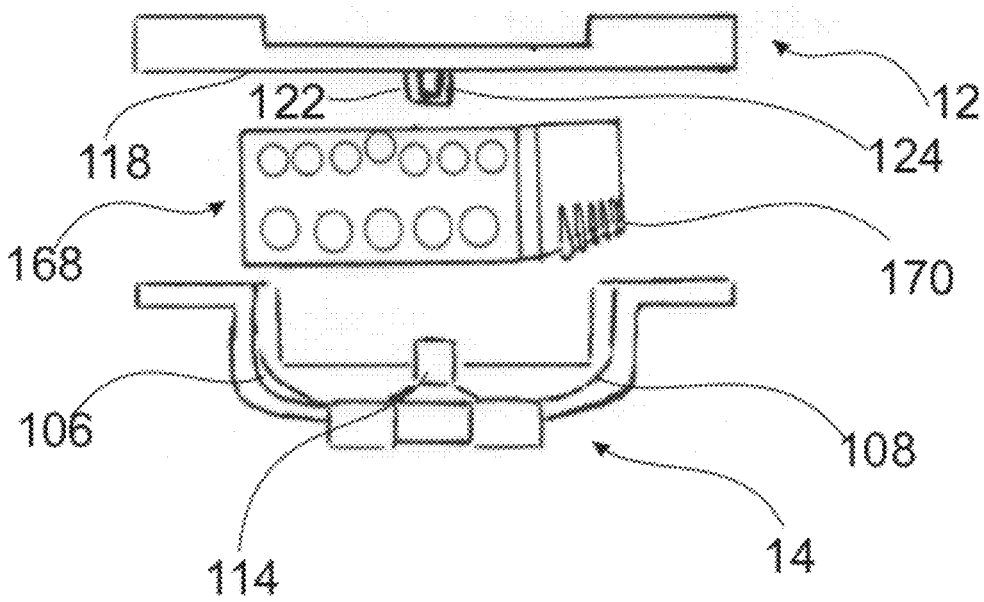
FIG. 19 is an exploded front perspective view showing a twelve pin trailer connector to be disposed inside the protective housing assembly.

FIG. 19 illustrates how different forms of connectors or connector assemblies can be used with the protective housing assembly. A twelve pin flat trailer connector assembly 168 has a plurality of protrusions 170 in the same form as those protrusions 82 on the connector assembly 80. The twelve pin flat trailer connector assembly 168 is aligned to housing cover 12 and main housing 14 in preparation to assemble the protective housing assembly 10. The twelve pin flat trailer connector assembly 168 is inserted into the main housing 14 and aligned with the main housing side walls. The protrusions on the side wall 170 align and mate with protrusions 108 of the internal chamber. Locating dowels 122, 124 and 114 all assist in aligning and securing the twelve pin flat trailer connector assembly 168 into the completed protective housing assembly 10.

Figure 20:
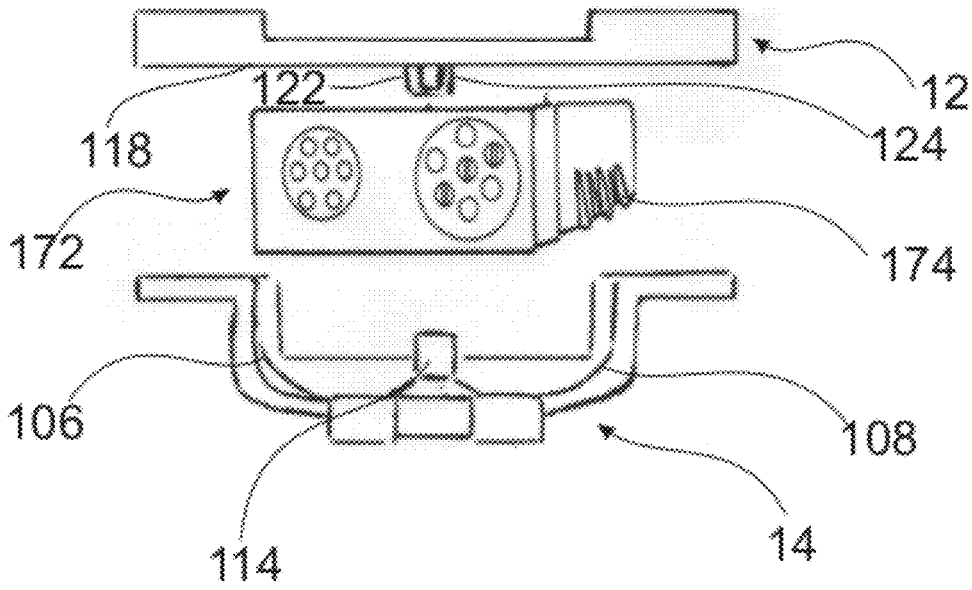
FIG. 20 is an exploded front perspective view showing a dual seven pin trailer connector to be disposed inside the protective housing assembly.

FIG. 20 shows another form of connector assembly that can be used in the housing in the form of a dual seven pin round trailer connector assembly 172 which has a plurality of protrusions 174 in the same form as those protrusions 82 on the connector assembly 80. The dual seven pin round trailer connector assembly 172 is aligned to top cover 12 and main housing 14 in preparation to assemble the protective housing assembly 10. The dual seven pin round trailer connector assembly 172 is inserted into the main housing 14 and aligned with the main housing side walls. The protrusions on the side wall 174 align and mate with protrusions 108 of the internal chamber. Locating dowels 122, 124 and 114 all assist in aligning and securing the dual seven pin round trailer connector assembly 172 into the completed protective housing assembly 10.

Figure 21:
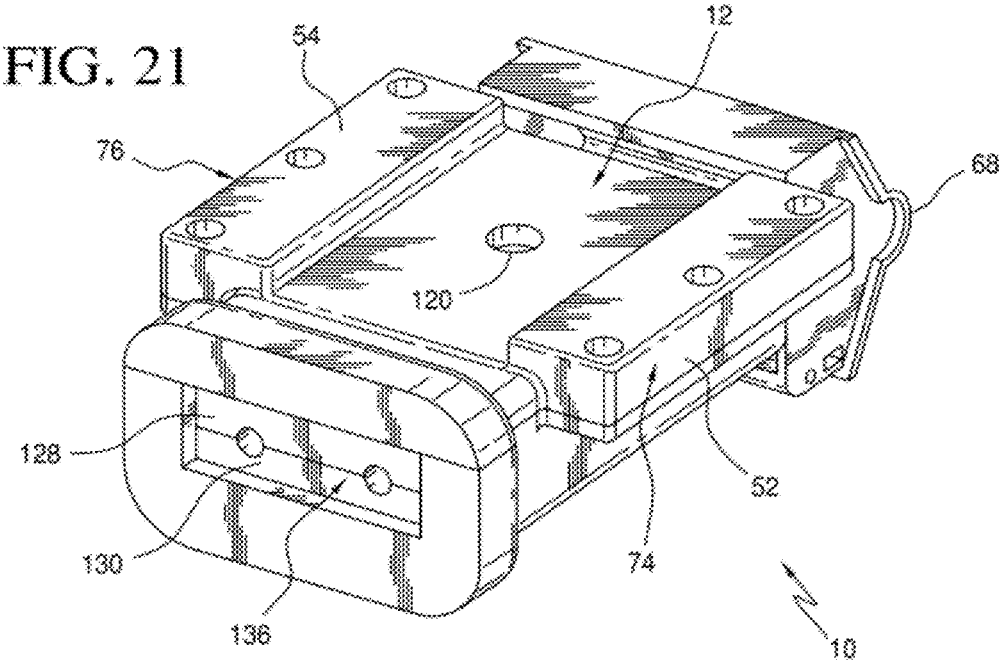
FIG. 21 is a perspective top side and rear end of the protective housing assembly.
Figure 22:
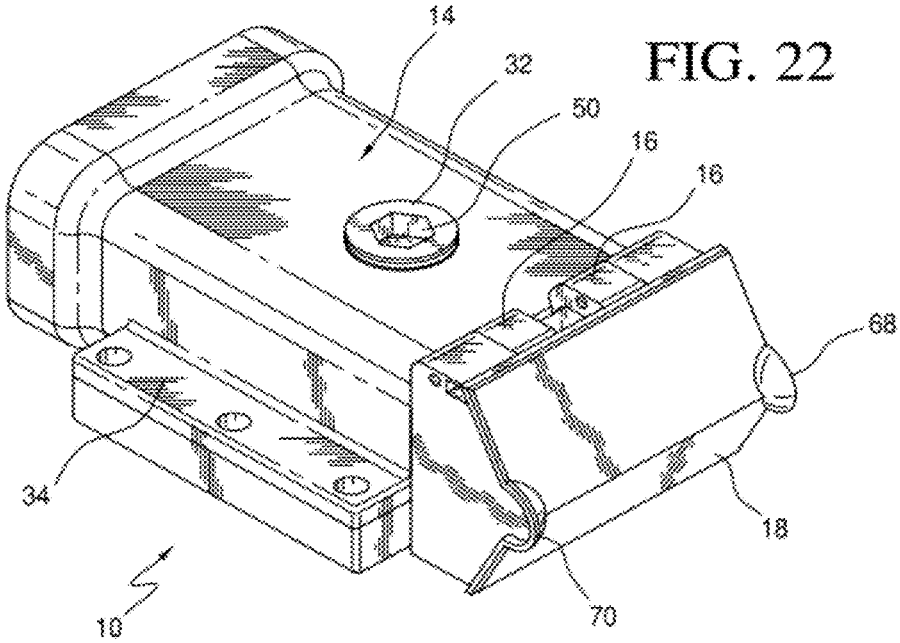
FIG. 22 is a perspective bottom side and front end view of the protective housing assembly.

FIGS. 21 and 22 show the various exterior features of the protective housing assembly 10.

Although the invention has been herein shown and described in what is conceived to be the most practical and preferred embodiment, it is recognized that departures can be made within the scope of the invention, which is not to be limited to the details described herein but is to be accorded the full scope of the appended claims so as to embrace and any all equivalent devices and apparatus.

We claim:

1. A connector, comprising:

a connector assembly including a connector assembly housing;

a main housing having an internal chamber for receiving therein the connector assembly housing;

a housing cover which mates with the main housing to cover the internal chamber;

the main housing including an opening at one end of the main housing with a hinged cover permitting access to the internal chamber;

a mating connector for being connected to the connector assembly when the hinged cover is in an open position, the mating connector including a fastening tab;

the fastening tab including a main tab for being interlocked with the hinged cover when in the open position to prevent the mating connector from unintentionally disconnecting from the connector assembly;

the connector assembly is attached to the main housing;

the main housing including a first aperture for receiving a fastener, the aperture being aligned with a second aperture in the connector assembly when the connector assembly is inserted into the internal chamber; and the housing cover including a third aperture for receiving the fastener, the third aperture being aligned with the second aperture of the connector assembly and aligned with first aperture in the main housing.

2. A connector as in claim 1, wherein the internal chamber is shaped to receive the contours of the connector assembly.

3. A connector as in claim 1, wherein the fastener includes a bolt.

4. A connector as in claim 1, wherein the hinged cover is permanently affixed to the main housing.

5. A connector as in claim 1, wherein the hinged cover has a seal that engages the main housing to seal the opening when the cover is closed.

6. A connector as in claim 5, wherein the attachment of the housing cover to the main housing, the hinged cover when closed and the sealing device create a protective barrier to the internal chamber.

7. A connector as in claim 1, wherein:

the main housing includes another opening at another end of the main housing to permit access to the internal chamber;

the another opening includes a sealing device for a cable; and the sealing device includes a thread and a constrictive gland which can be tightened around the cable by a gland nut being screwed onto the thread, thereby compressing the constrictive gland around the cable.

8. A connector as in claim 7, wherein:

the main housing includes another opening at another end of the main housing to permit access to the internal chamber; and the attachment of the housing cover to the main housing, the hinged cover when closed and the sealing device create a protective barrier to the internal chamber.

9. A connector as in claim 1, wherein:

the main housing includes another opening at another end of the main housing to permit access to the internal chamber;

the another opening includes a sealing device for a cable; and the sealing device includes two half seals having wire entry cut outs, the half seals being inserted into respective slots of the main hosing and housing cover, the half seals being compressed when the main housing and housing cover are attached together, forming a seal around a respective cable at the wire entry cutouts.

10. A connector as in claim 1, wherein:

the fastening tab comprises a main body with a plurality of pins with locking heads inserted into mating apertures in the mating connector, the pins extending from the main body; and the main tab is attached to the main body.

11. A connector as in claim 10, wherein:

the hinged cover has a front wall that engages the main tab when the mating connector is attached to the connector assembly.

12. A protective housing assembly for a connector, comprising:

a main housing having an internal chamber for receiving therein a connector assembly, the internal chamber having a first dowel for insertion into an aperture in the connector assembly, thereby to position the connector assembly within the chamber;

a housing cover including a second dowel for insertion into the aperture of the connector assembly, thereby to interlock the housing cover with the connector assembly and the main housing;

the housing cover being attached to the main housing to cover the internal chamber;

an opening at one end of the main housing with a hinged cover to permit access to the internal chamber;

another opening at another end of the main housing to permit access to the internal chamber; and the main housing and the housing cover including flanges for attachment to a surface.

13. A protective housing assembly for a connector as in claim 12, wherein the housing cover includes a projection having an end portion for engaging on a surface of the connector assembly.

14. A protective housing assembly for a connector as in claim 12, wherein:

the main housing and the housing cover include aligned apertures; and a fastener disposed through the aligned apertures.

15. A protective housing assembly for a connector as in claim 12, wherein the hinged cover is permanently affixed to the main housing.

16. A protective housing assembly for a connector as in claim 12, wherein the hinged cover has a seal that seals the opening to the main housing when the hinged cover is closed.

17. A protective housing assembly for a connector as in claim 12, wherein:

the another opening includes a sealing device for a cable; and the sealing device includes a thread and a constrictive gland which can be tightened around the cable by a gland nut being screwed onto the thread, thereby compressing the constrictive gland around the cable.

18. A protective housing assembly for a connector as in claim 12, wherein::

the another opening includes a sealing device for a cable; and the sealing device includes two half seals having wire entry cutouts, the half seals being inserted into respective slots of the main hosing and housing cover, the half seals being compressed when the main housing and housing cover are attached together, forming a seal around a respective cable at the wire entry cutouts.

19. a connector assembly including a connector assembly housing;

a main housing having an internal chamber for receiving therein the connector assembly housing;

a housing cover which mates with the main housing to cover the internal chamber;

the main housing including an opening at one end of the main housing with a hinged cover permitting access to the internal chamber;

a mating connector for being connected to the connector assembly when the hinged cover is in an open position, the mating connector including a fastening tab;

the fastening tab including a main tab for being interlocked with the hinged cover when in the open position to prevent the mating connector from unintentionally disconnecting from the connector assembly;

the main housing including another opening at another end of the main housing to permit access to the internal chamber;

the another opening including a sealing device for a cable; and the sealing device including a thread and a constrictive gland which can be tightened around the cable by a gland nut being screwed onto the thread, thereby compressing the constrictive gland around the cable.

20. a connector assembly including a connector assembly housing;

a main housing having an internal chamber for receiving therein the connector assembly housing;

a housing cover which mates with the main housing to cover the internal chamber;

the main housing including an opening at one end of the main housing with a hinged cover permitting access to the internal chamber;

a mating connector for being connected to the connector assembly when the hinged cover is in an open position, the mating connector including a fastening tab;

the fastening tab including a main tab for being interlocked with the hinged cover when in the open position to prevent the mating connector from unintentionally disconnecting from the connector assembly;

the main housing including another opening at another end of the main housing to permit access to the internal chamber;

the another opening including a sealing device for a cable; and the sealing device includes two half seals having wire entry cutouts, the half seals being inserted into respective slots of the main hosing and housing cover, the half seals being compressed when the main housing and housing cover are attached together, forming a seal around a respective cable at the wire entry cutouts.

21. a connector assembly including a connector assembly housing;

a main housing having an internal chamber for receiving therein the connector assembly housing;

a housing cover which mates with the main housing to cover the internal chamber;

the main housing including an opening at one end of the main housing with a hinged cover permitting access to the internal chamber;

a mating connector for being connected to the connector assembly when the hinged cover is in an open position, the mating connector including a fastening tab;

the fastening tab including a main tab for being interlocked with the hinged cover when in the open position to prevent the mating connector from unintentionally disconnecting from the connector assembly;

the fastening tab comprising a main body with a plurality of pins with locking heads inserted into mating apertures in the mating connector, the pins extending from the main body; and the main tab is attached to the main body.

* * * * *